United States Patent [19]

Crosby et al.

[11] 4,037,829

[45] July 26, 1977

[54] SPRING CONSTRUCTION

[76] Inventors: Lawton H. Crosby; John L. Crosby, both of 403 Center, Lake Bluff, Ill. 60044

[21] Appl. No.: 664,384

[22] Filed: Mar. 5, 1976

Related U.S. Application Data

[63] Continuation-in-part of Ser. No. 466,383, May 2, 1974.

[51] Int. Cl.[2] ..... F16F 3/00

[52] U.S. Cl. ..... 267/110; 5/255; 5/259 R; 297/452

[58] Field of Search ..... 267/110, 102, 104, 105, 267/106, 107, 108, 109, 111, 112, 87; 5/255, 259 R, 259 B, 260, 261, 262, 263; 297/452

[56] References Cited

U.S. PATENT DOCUMENTS

| | | | |
|---|---|---|---|
| 1,890,090 | 12/1932 | Kronheim | 267/112 |
| 2,234,230 | 3/1941 | Burke | 267/112 |
| 3,288,503 | 11/1966 | Slominski | 267/110 |

*Primary Examiner*—James B. Marbert
*Attorney, Agent, or Firm*—Richard G. Lione

[57] ABSTRACT

A rail anchor and attachment assembly for securing the end of a sinuous spring band to a curved frame rail in a furniture frame. The anchor is a pin fabricated from heavy gauge wire. It comprises a vertical anchor leg seated against the back surface of a frame rail and depending from a horizontal attachment leg. An attachment hook on the free end of the attachment leg receives a spring band, a helical connector spring or some other form of band connector, to form an attachment assembly joining the band to the rail.

8 Claims, 8 Drawing Figures

SPRING CONSTRUCTION

FIELD OF THE INVENTION

This application is a continuation-in-part of application Ser. No. 466,383, filed May 2, 1974, entitled SPRING CONSTRUCTION. This invention relates in general to furniture spring assemblies. It deals more particularly with furniture spring assemblies of the type employing sinuous spring bands.

BACKGROUND OF THE INVENTION

In a furniture spring assembly of this type, a series of sinuous spring bands are normally stretched between the front and back rails of a seat frame in parallel, spaced relationship. The bands may be attached to the rails by conventional anchor clips stapled or nailed on the top surface of each rail or by other conventional means. In the alternative, they might be attached in the manner illustrated in U.S. Pat. No. 3,790,149, issued Feb. 4, 1974, entitled SPRING CONSTRUCTION, or U.S. Pat. No. 3,773,310, issued Nov. 20, 1973, entitled SPRING CONSTRUCTION, both illustrating furniture spring assemlbies including sinuous spring band attachment assemblies and clips developed by the applicant.

When either the front or back rails, or both, are curved, however, the effective anchoring of sinuous spring bands to the curved rail(s) is more difficult. The linear end segments of a band will not mate properly with clips which are conventionally fastened to the rails, for example. The effective anchor point on each end of a band ends up being out of longitudinal alignment with the center line of the band, producing uneven spring resilience when a person sits on the furniture spring seat. In addition, other related complications in spring attachment and performance are created by curved rails in furniture seats. For example, conventionally it has been necessary to use a plurality of different spring band lengths. It is also frequently necessary to attach a clip in close quarters under a back stuffing rail, which is normally immediately over the back frame rail in curved rail goods.

SUMMARY OF THE INVENTION

It is an object of the present invention to provide an improved rail anchor for securing the end of a sinuous spring band to the frame rail in a furniture frame or the like. It is another object to provide a rail attachment assembly which is particularly adapted for attachment of a sinuous spring band to the rails in curved rail furniture. It is still another object to provide an improved rail anchor including an anchor pin which is inexpensive to fabricate and extremely simple to mount on a frame rail.

The foregoing and other objects are realized in accord with the invention by providing an anchor pin fabricated of 11 or 12-gauge wire. The pin might take several forms, but basically it comprises a single vertical anchor leg depending from a single horizontal attachment leg. In one aspect of the invention, a universal attachment hook extends inwardly from the forwardmost end of the attachment leg and it is to this hook that the end of the band is secured, either through a conventional helical spring or links such as illustrated in the aforementioned U.S. Pat. No. 3,790,149. In another aspect of the invention, the hook is supplanted by a horizontal loop for attachment to a spring end J-hook.

The rail anchor is actually an assembly of the curved rail itself, an anchor pin, and (normally) a transition member for securing the body of the band to the pin. The pin seats on the top surface of the rail or extends through the rail, perpendicular to a tangent to the curve of the rail. Regardless of which arrangement is utilized, the attachment is made simply and easily. The attachment point of the band is automatically on the longitudinal axis of the band, regardless of where on the curve of the rail the band is connected. The rail anchor makes it practical to utilize only one length spring band. Uniform seating from left to right is achieved.

BRIEF DESCRIPTION OF THE DRAWINGS

The invention, including its construction and method of operation, together with other objects and advantages thereof, is illustrated more or less diagrammatically in the drawings, in which.

DESCRIPTION OF THE PREFERRED EMBODIMENTS

Figure 1:
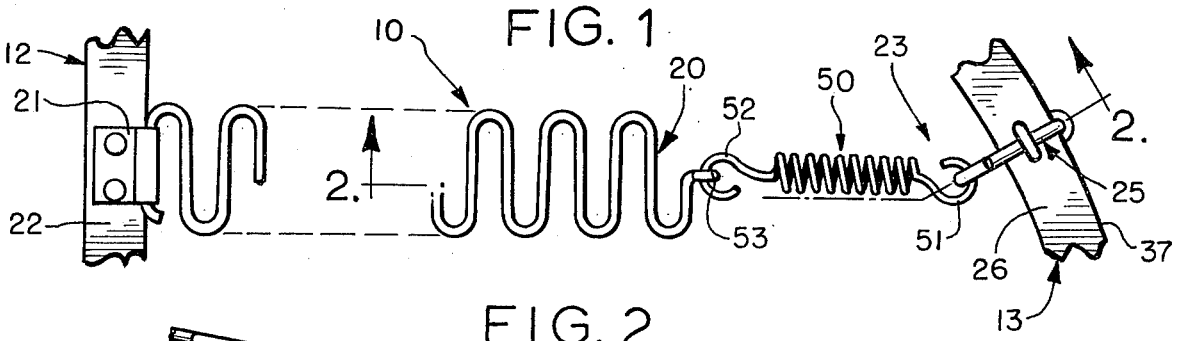
FIG. 1 is a top plan view of a curved rail furniture spring assembly incorporating a rail anchor embodying features of a first form of the present invention, with parts removed.

Referring now to the drawings, and particularly to FIG. 1, a portion of a furniture spring seat assembly is illustrated generally at 10. In the present invention, the seat assembly 10 comprises a straight front rail 12 and a curved back rail 13 of a generally conventional furniture frame for a chair or the like.

Anchored to the front and back rails in spaced, parallel relationship, are a series of sinuous spring bands 20, only one of which is shown. In the present illustration, each spring band 20 is anchored to the straight front rail 13 by a conventional EK clip 21 stapled to the top surface 22 of the rail. The spring band 20 is anchored to the curved back rail 13 by a rail anchor 23 embodying features of a first form of the present invention.

Figure 2:
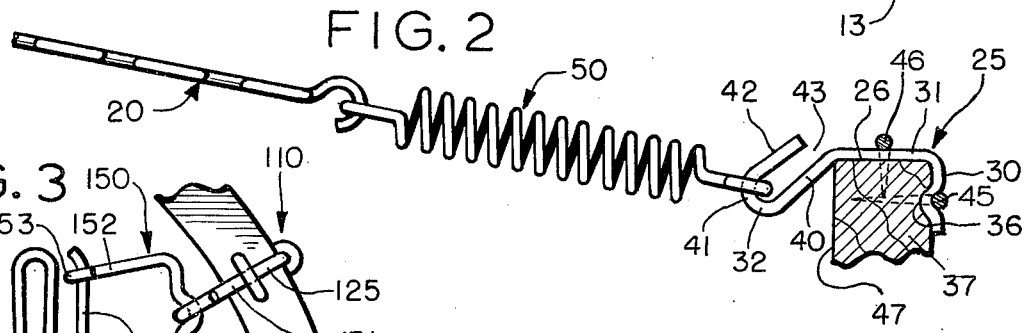
FIG. 2 is a sectional view taken along line 2—2 of FIG. 1.

Referring now to FIG. 2, as well, the rail anchor 23 will be seen to include an anchor pin 25 extending horizontally across the top surface 26 of the back rail 13 normal to a tangent to the rail. The rail anchor pin 25 includes a vertical anchor leg 30, depending from a horizontal attachment leg 31. Extending inwardly from the front end of the attachment leg 31 is an attachment hook 32. The anchor pin 25 is fabricated from 11 or 12-gauge wire, which may be hardened by tempering.

The depending anchor leg 30 is a vertical wire segment deformed inwardly intermediate its ends, as at 36, to form a pointed protrusion designed to embed in the back surface 37 of the rail 13 in a manner hereinafter discussed. The attachment leg 31 of the rail anchor pin 25 extends horizontally straight forward from the upper end of the vertical segment 36 in the anchor leg 30.

The attachment hook 32 extends inwardly from the front end of the attachment leg 31. The hook 32 comprises an inner segment 40 extending downwardly at a 45° angle for ⅜inch. The hook 32 then curves upwardly and rearwardly through 190° on a ¼ inch inner diameter in a curved segment 41. Finally after curving for 190°, a straight segment 42 of the hook 32 ⅛ inch long terminates it. A mouth 43 having a 3/16 inch opening is left for entry to the hook 32.

In the furniture spring seat assembly 10 illustrated in FIGS. 1 and 2, the anchor leg 30 seats flush against the back surface 37 of the back rail 13, as has been pointed out. The protrusion 36 is embedded in the surface 37 and a conventional staple 45 driven into the surface 37 over the leg 30 in alignment with the protrusion in the manner illustration.

The attachment leg 31 is in turn secured to the top rail surface 26 by another staple 46. The overall length of the attachment leg 31 is such that with the anchor leg 30 seated flush against the back surface 37 of the rail 13 the hook's inner segment 40 is inclined downwardly precisely at the front surface 47 of the rail 13.

In the furniture spring seat assembly 10 a helical spring 50 has one end hook 51 seated in the attachment hook 32 and the other end hook 52 seated on a conventional J-hook 53 end of the spring band 20. It will be seen that the longitudinal axis of the spring band 54 lies at an angle of approximately 60° with the tangent to the back rail 13 at the point of mounting on the rail anchor pin 25. However, the point of attachment; i.e., the hook 32, lies on the longitudinal axis of the band 20. Accordingly, the band 20 expands and contracts uniformly when seating pressure is applied by a person resting on the spring assembly 10, resulting in excellent seating characteristics for the curved rail furniture.

Obviously there is an off-center force factor applied to the anchor pin because of the angular relationship of the attachment leg 31 and the band 20. However, the pin 25 doesn't cock askew because the inclined hook segment 40 binds against the rail 13 at the juncture of the rail's top surface 26 and its front surface 47 and prevents sideward movement of the hook 32. The staples 45 and 46 and the embedded protrusion 36 further serve to lock the pin in place. Accordingly, the pin 25 doesn't shift during use.

Figure 3:
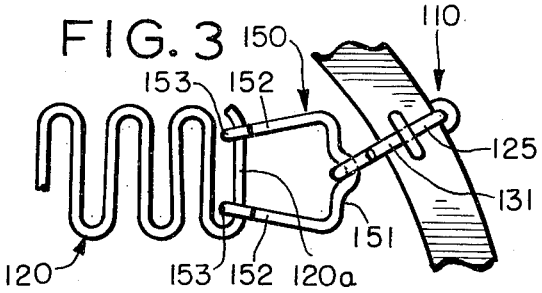
FIG. 3 is an enlarged top plan view of a rail anchor embodying a modified first form of the present invention.

A modified version of the rail anchor 10 is seen at 110 in FIG. 3. It differs solely in that the helical spring 50 is replaced by a swing anchor 150 such as is illustrated in FIG. 11 of the aforementioned U.S. Pat. No. 3,790,149.

The swing anchor 150 is fabricated of 12½ or 13 gauge wire and comprises a generally U-shaped member having a base leg 151 interconnecting side legs 152 and 153. The side legs 152 and 153 converge slightly from their juncture with the base leg 151 to identical open mouth hooks 153 formed on the free ends of the legs 152. The endmost linear segment **120*a* of a sinuous spring band 120 is adapted to seat in the hooks 153** in the manner illustrated.

The operation of the rail anchor 110 in a seat assembly produces the same advantages results as the rail anchor 10 hereinbefore discussed. The off-center force factor applied to the anchor pin 125 because of the angular relationship of the attachment leg 131 and the band 120 is counteracted.

The pin 125 does not cock askew because its hook 132 binds against the rail 113 in the same manner as the pin 25 herein-before discussed. This prevents sideward movement of the hook 32.

Figure 4:
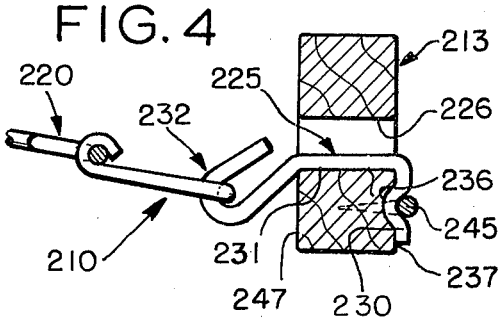
FIG. 4 is a view similar to FIG. 2 illustrating another modified first form of the anchor link embodying features of the present invention.

Another modified version of the rail anchor 10 is seen at 210 in FIG. 4. It differs from the rail anchor 125 immediately hereinbefore discussed only in that the anchor pin, designated by the reference numeral 225 in this instance, extends through a bore 226 rather than being seated on the upper surface of the frame rail 213.

In the furniture spring assembly 210, the anchor leg 230 of the pin 225 seats flush against the back surface 237 of the back rail 213. The protrusion 236 is embedded in the surface 237 and a conventional staple 245 driven into the surface 237 over the leg 230 of the pin 225 in the manner illustrated.

The overall length of the attachment leg 231 is such that with the anchor leg 230 seated flush against the back surface 237 of the rail 213 the attachment hook 232 has its inner segment 230 inclined downwardly precisely at the front surface 247 of the rail 213. In this instance, however, the attachment leg 231 is seated against the lowermost surface of the bore 226.

Once again, there is an off-center force factor applied to the anchor pin 225 because of the angular relationship of the attachment leg 231 and the band 220. However, the pin 225 doesn't cock askew because the inclined hook segment 240 binds against the rail 213 at the juncture of the rail's front surface 247 and the bore 226.

Figure 5:
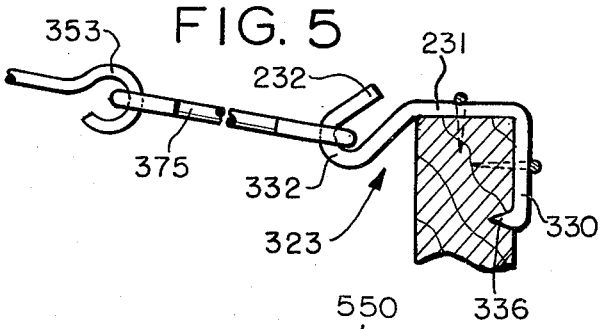
FIG. 5 is a sectional view similar to FIG. 2 illustrating a second form of the rail anchor embodying features of the invention.

Referring now to FIG. 5, a second form of the rail anchor embodying features of the invention is seen generally at 323. The anchor 323 is quite similar to the anchor 23 of the first form of the invention.

The anchor 323 is distinguished from the anchor 23, for example, only in that a protrusion 336 is formed on its anchor leg 330 at the lower end of the leg rather than intermediate the ends of the legs. This is merely a different manufacturing technique. The effect on the spring assembly 310 is substantially the same.

It should be noted that in lieu of the helical spring 50 shown in the spring assembly 10, however, a simple "radius link" 373 is illustrated connecting the attachment hook 332 of the anchor pin 323 to a J-hook 353 on the end of a conventional sinuous spring band. The "radius link" is of the type illustrated in FIGS. 15 and 16 of the aforementioned U.S. Pat. No. 3,790,149.

Figure 6:
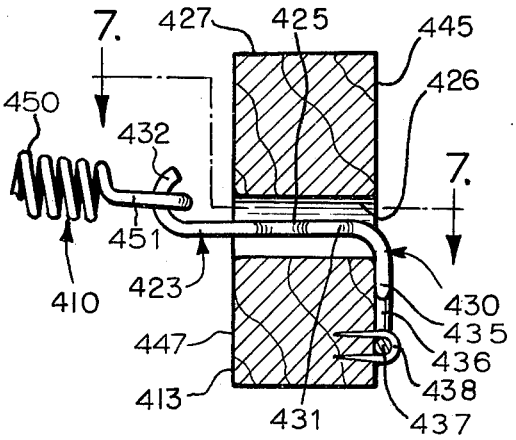
FIG. 6 is a sectional view similar to FIG. 2 illustrating a third form of the rail anchor embodying features of the invention.
Figure 7:
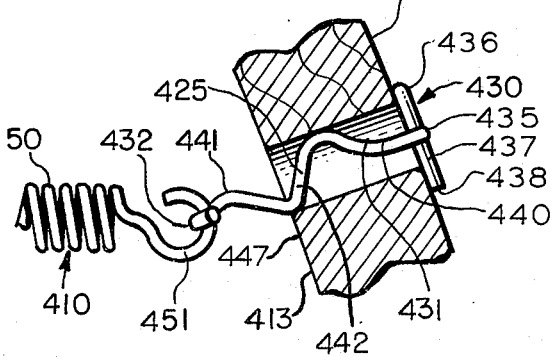
FIG. 7 is a sectional view taken along line 7—7 of FIG. 6.

Referring now to FIGS. 6 and 7 of the drawings, a portion of a spring assembly 410 incorporating a rail anchor 423 embodying features of a third form of the invention is illustrated. The rail anchor 423 will be seen to include an anchor pin 425 extending horizontally through a bore 426 drilled through the back rail 413 of a furniture frame normal to a tangent of the rail. The bore 426 is approximately 7/16 in diameter and is disposed, at its center line, at any desired point below the top surface 427 of the back rail 413.

The rail anchor 425 includes a vertical anchor leg 430, depending from a horizontal attachment leg 431. Upstanding from the front end of the attachment leg 431 is an attachment post 423. The anchor pin 425 is fabricated from 11 or 12 gauge wire, which may be hardened by tempering.

The depending anchor leg 430 comprises an upper vertical wire segment 435, an intermediate segment 436 extending at an angle 45° from the vertical at the lower end of the vertical segment, and a horizontal segment 437 which extends from the lower end of the canted intermediate segment 436, transversely across the vertical axis of the vertical segment 435, to its free end 438 disposed opposite this vertical axis.

The attachment leg 431 of the rail anchor pin 425 extends horizontally forward from the upper end of the vertical segment 435 in the anchor leg 430. The attachment leg 431, as seen in FIG. 7, comprises a rear straight segment 440 and a front straight segment 441 which bracket an S-shaped intermediate segment 442.

The attachment hook 432 extends upwardly from the front end of the front straight segment 441 in the attachment leg 431. The anchor post 432 is approximately ⅜ inch high and is curved slightly rearwardly in the direction of the anchor leg 430 so that it defines approximately a 25° angle with the vertical.

In the assembly 410 illustrated in FIGS. 6 and 7, the rail anchor pin 425 is mounted in the bore 426, as has been pointed out. The anchor leg 430 seats flush against the back surface 445 of the back rail 413. The arrangement of the canted intermediate segment 436 and the horizontal segment 437 of the anchor leg 430 provide a stable mounting platform for the anchor leg 430 against this back surface 445.

The overall transverse dimensions of the intermediate segment 442 in the attachment leg 431 of the rail anchor pin 425 are approximately equal to the diameter of the anchor bore 426. Accordingly, the straight segment 440 and 441 of the attachment leg 431 are centered transversely of the bores 426 because their movement is limited by the relatively snug fit of the S-shaped intermediate segment 442 in the bore.

The overall length of the attachment leg 431 is such that with the anchor leg 430 seated flush against the back surface 445 of the rail 413 the base of the attachment post 432 is disposed approximately ½ inch inwardly of the front surface 447 of the rail 413. The attachment post 432 is curved rearwardly, as has been pointed out, so that a gap of approximately 3/16 inch is left between the upper end of the post and the front surface 447.

In the spring assembly 410, a helical spring 450 has one end hook 451 seated in the attachment post 432. It will be seen that the longitudinal angle of the helical spring 450 lies at an angle of approximately 60° with the tangent to the back rail 413 at the point of mounting of the rail anchor pin 425. However, the point of attachment; i.e., the anchor hook 432, lies on the longitudinal axis of the helical spring 450. Accordingly, this sinuous spring band (not shown) expands and contracts uniformly when seating pressure is applied by persons resting on the spring assembly 10, resulting in excellent seating characteristics for the curved rail furniture.

Once again, there is an off-center force factor applied to the anchor pin 425 because of the angular relationship of the attachment leg 431 and the helical spring 450. However, the S-shaped intermediate segment 442 and its transverse dimensional relationship, vis-a-vis the anchor bore 426, prevents the anchor pin 425 from cocking askew. The canted intermediate segment 436 and horizontal segment 437 of the anchor leg 430 remain substantially flush against the back surface 445 of the rail 413. The pin 425 doesn't shift during use.

With the anchor pin 425 mounted through a bore 426 in the manner described, only one anchoring staple 438 is required to hold the pin. Accordingly, assembly of the furniture spring assembly 410 is simplified. With the back rail attachment being at any desired point below the top surfce 427 of the back rail 413, as is desirable in many pieces of modern furniture, for example, any desired cushion pitch is accomplished.

Figure 8:
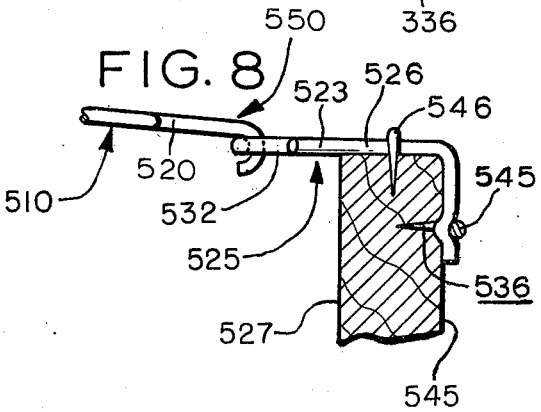
FIG. 8 is a sectional view similar to FIGS. 2 and 5 illustrating a fourth form of the rail anchor embodying features of the invention.

Referring now to FIG. 8, a fourth form of rail anchor embodying features of the invention is illustrated at 523 in a spring assembly 510. The rail anchor 523 includes a pin 525 identical in construction to the pin 25 hereinbefore discussed, except that in lieu of the vertically oriented hook 32 a horizontally disposed attachment hook 532 is utilized. The pin 525 is seated on the top surface 526 of the rail. The protrusion 536 embeds in the back surface 537 of the rail. A conventional staple 545 secures it. Another staple 546 fastens the pin to the top surface 526.

A Z-hook 550 on the spring band 520 seats in the hook 532 on the pn 525. In the alternative, of course, a helical and Z-hook might be employed or other forms of attachment of the band 520 to the hook 532.

The spring assemblies 10 through 510 have been described here solely in terms of a curved back rail. However, in the alternative, the front rail alone might be curved or both rails curved. In either case, the rail anchors 23 through 523 embodying features of the invention can be used at both rails to the same advantage.

Regardless of whether helicals or connecting links of various types are used, they may be varied in length so that one or two lengths of a sinuous spring band are sufficient to fit several frame sizes. As a result, the manufacturer needn't stock a half-dozen different band lengths. His costs are reduced commensurately.

While several embodiments described herein are at present considered to be preferred, it is understood that various modifications and improvements may be made therein, and it is intended to cover in the appended claims all such modifications and improvements as fall within the true spirit and scope of the invention.

What is desired to be claimed and secured by Letters Patent of the United States is:

1. A rail attachment assembly comprising:

a. a curved frame rail having a back surface, a top surface, and a front surface, and b. an anchor pin including an anchor leg seated against said back surface of said rail, a horizontal attachment extending from said anchor leg across the width of said rail, and an attachment hook extending inwardly from said front surface of said rail and connected to a normally arced sinuous spring band, c. the longitudinal axis of said attachment leg extending perpendicular to a tangent to the curvature of the rail and the longitudinal axis of the band extending at an angle to said attachment leg axis.

2. The rail attachment assembly of claim 1 further characterized in that:

a. said attachment hook is formed downwardly at an angle of approximately 45 degrees from said attachment leg at a point in vertical alignment with said front surface of the rail.

3. The rail attachment assembly of claim 1 further characterized in that:

a. said attachment leg is seated on said upper surface of said rail.

4. The rail attachment assembly of claim 1 further characterized in that:

a. said attachment leg extends through a bore formed horizontally through said rail and is seated against the lowermost surface of said bore.

5. The rail attachment assembly of claim 4 further characterized in that:

a. said attachment leg includes a segment formed so that it extends a predetermined distance transversely of the longitudinal axis of said attachment leg.

6. The rail attachment assembly of claim 3 further characterized in that:

a. said attachment leg includes a segment formed so that it extends a predetermined distance transversely of the longitudinal axis of said attachment leg.

7. The rail attachment assembly of claim 6 further characterized in that:

a. said anchor leg includes a segment formed so that it extends a predetermined distance transversely of the longitudinal axis of said anchor leg, b. said anchor leg segment being seated flush against the outer rail surface.

8. The rail attachment assembly of claim 5 further characterized in that:

a. said anchor leg includes a segment formed so that it extends a predetermined distance transversely of the longitudinal axis of said anchor leg, b. said anchor leg segment being seated flush against the outer rail surface.

* * * * *

UNITED STATES PATENT AND TRADEMARK OFFICE

CERTIFICATE OF CORRECTION

PATENT NO. : 4,037,829

DATED : July 26, 1977

INVENTOR(S) : Lawton H. Crosby; John L. Crosby

It is certified that error appears in the above-identified patent and that said Letters Patent are hereby corrected as shown below:

Column 1, line 24 "assemlbies" should read -- assemblies --

Column 1, line 27 "When" should read -- Where --

Column 3, line 51 after "pin" insert -- 25 --

Column 4, line 6 "herein-before" should read -- hereinbefore --

Column 4, line 58 "7/16 in" should read -- 7/16 inch --

Column 4, line 63 "423" should read -- 432 --

Column 6, line 2 "surfce" should read -- surface --

Column 6, line 17 "pn" should read -- pin --

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*